United States Patent [19]

Schrader et al.

[11] Patent Number: 5,036,164

[45] Date of Patent: Jul. 30, 1991

[54] MULTIPLE TAP GROUND CONNECTOR

[75] Inventors: Gary E. Schrader, Manchester; H. Thomas Nelson, Bedford, both of N.H.

[73] Assignee: Burndy Corporation, Norwalk, Conn.

[21] Appl. No.: 558,005

[22] Filed: Jul. 25, 1990

[51] Int. Cl.[5] ..... H01R 4/18; H01R 4/66

[52] U.S. Cl. ..... 174/94 R; 174/7; 403/285; 403/391; D13/149

[58] Field of Search ..... 174/6, 7, 71 R, 84 C, 174/90, 94 R; 24/115 A, 129 W; 29/873, 514; 403/278, 281, 285, 385, 391; 439/92, 880; D13/149

[56] References Cited

U.S. PATENT DOCUMENTS

| | | | |
|---|---|---|---|
| 2,004,999 | 6/1935 | McIlvane | 403/391 |
| 2,427,518 | 9/1947 | Bergan | 174/90 X |
| 2,884,478 | 4/1959 | Becker et al. | 174/94 R |
| 2,938,069 | 5/1960 | Toedtman et al. | 174/94 R |
| 2,956,108 | 10/1960 | Brenner | 174/94 R |
| 2,964,585 | 12/1960 | Nilsson et al. | 174/71 R X |
| 3,060,258 | 10/1962 | Spurgeon | 403/391 X |
| 3,340,352 | 9/1967 | Teagno et al. | 174/94 R |
| 3,354,517 | 11/1967 | Levinsky | 174/71 R X |
| 3,916,517 | 11/1975 | Luongo | 174/94 R X |

FOREIGN PATENT DOCUMENTS

| | | | |
|---|---|---|---|
| 1046293 | 7/1953 | France | 174/175 |
| 54873 | 3/1968 | Poland | 174/94 R |

*Primary Examiner*—Laramie E. Askin

*Attorney, Agent, or Firm*—Burtsell J. Kearns; Patrick J. Walsh

[57] ABSTRACT

Several configurations of compression ground connectors to allow for one, two, three or more taps from a single ground connector to an installation requiring grounding. The installation is completed using a single crimping stroke.

6 Claims, 2 Drawing Sheets

MULTIPLE TAP GROUND CONNECTOR

BACKGROUND OF THE INVENTION

The present invention relates to ground connectors and particularly to those used for perimeter ground systems in telecommunications installations.

Compression ground systems have been used for many years with a complete system consisting of a cable grid having taps, splices, cable to ground rod, ground plates and terminations. The cable grid is interconnected by use of compression ground connectors in which ground rods and cables are bound together by the connectors after they are crimped or compressed into place utilizing known hydraulic compression installation tools.

These compression ground systems are typically employed in the telecommunications field a for example grounding microwave towers or as perimeter grounds for buildings accommodating telecommunications equipment. The grounding includes lightning grounds for microwave towers and other structures and for equipment grounds for electronic equipment used in telecommunications buildings.

SUMMARY OF THE INVENTION

The present invention is directed to compression connectors in which ground rods can be connected to one or more taps using a single connector. In one embodiment of the invention the connector is a so-called figure-8 connector having one opening for receiving a ground rod for connection to a perimeter ground grid and a plurality of openings for connecting conductors to the particular installation to be grounded, such as microwave tower legs, building equipment, and so forth. In this embodiment of the invention, the connector conductor openings are within the perimeter of the figure-8 configuration such that ground conductors are cut in each case during installation of a grounding connection.

In another configuration of figure-8 connector, the conductor openings are accessible from the periphery of the conductor in order to establish continuous tap connections which avoid the need for any cutting or splicing ground wires.

The invention also includes continuous run and tap connectors involving an open figure-8 in which the connector may be hooked on the ground rod and crimped into place together with peripheral access along the surface of the connector for continuous run and tap conductors.

The invention also includes several figure-6 configurations with conductor connections for both cut and continuous taps.

OBJECTS OF THE INVENTION

It is an object of the invention to provide a single ground connector capable of receiving a plurality of taps or ground connectors.

It is a further object of the invention to provide ground connectors allowing for a plurality of taps in which the ground conductor is spliced or cut.

It is a further object of the invention to provide ground connectors for accommodating a plurality of taps (1 or more) in continuous run configuration.

Another object is to provide a connector for accommodating a plurality of taps in which the installation is completed in a single crimp.

Other and further objects of the invention will occur to one skilled in the art upon the employment of the invention in practice or upon an understanding of the following detailed description of the invention.

BRIEF DESCRIPTION OF THE DRAWING

A preferred embodiment of the invention has been chosen for purposes of description and is shown in the accompanying drawing in which.

DETAILED DESCRIPTION OF PREFERRED EMBODIMENT

Figure 1:
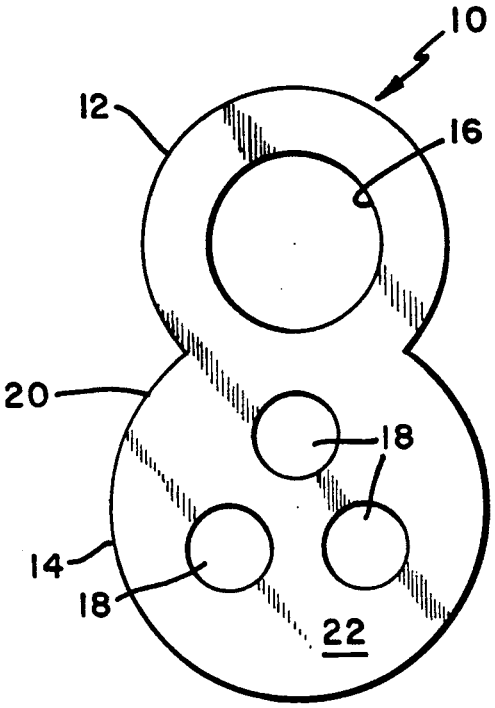
FIG. 1 is a front view of a figure-8 connector according to the invention for receiving a plurality of cut conductors.
Figure 2:
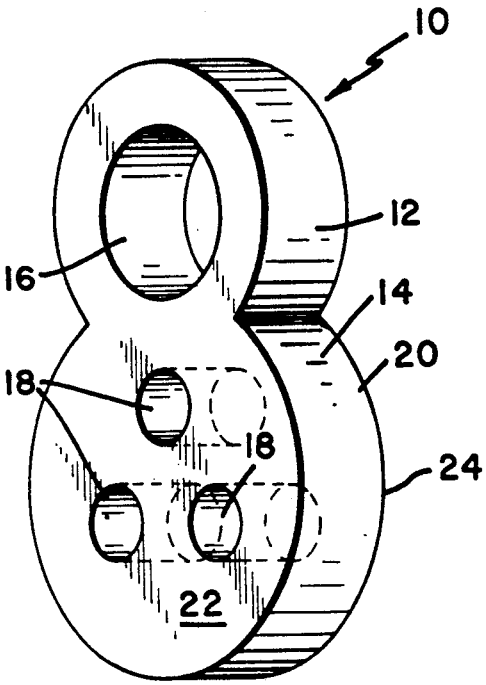
FIG. 2 is a perspective view thereof.
Figure 8:
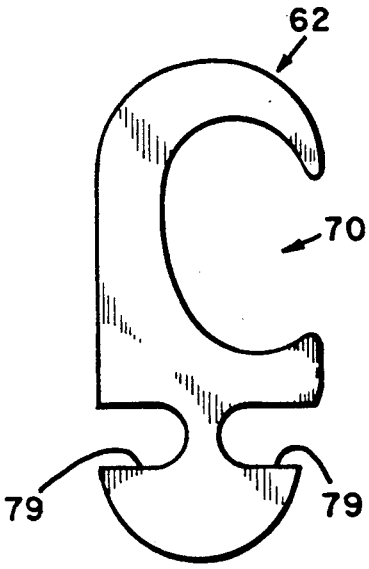
FIGS. 8 and 9 are figure-6-type connectors which can accommodate continuous run conductors.

Referring now to the drawing, FIGS. 1 and 2 illustrate a figure-8 connector 10 which is preferably extruded copper with or without electro-tinplating and has upper 12 and lower 14 body portions for receiving respectively a ground rod and ground conductors. Ground rods are copper clad, stainless steel, or galvanized steel. An upper opening 16 typically receives a ground rod of ⅝" diameter. The opening can be sized to accommodate ground rods of from ⅜ to 1 inch diameter according to particular applications. The lower portion of the figure-8 connector is provided with a plurality of openings 18 located within the perimeter 20 of the connector being of lesser diameter than the ground rod opening and extending through the front 22 and rear 24 faces of the connector. Typically the ground conductor openings receive #2 solid tinned copper conductors for connection to the installation or equipment being grounded. In this embodiment of the invention the connectors are cut terminating one end at the connector and the other end at the installation or equipment grounded.

For completing the installation, the assembly of ground wire and ground rod positioned in the connector is compressed by means of a known hydraulic compression tool for purposes of completing the fitting. A single crimping operation completes an installation.

Figure 3:
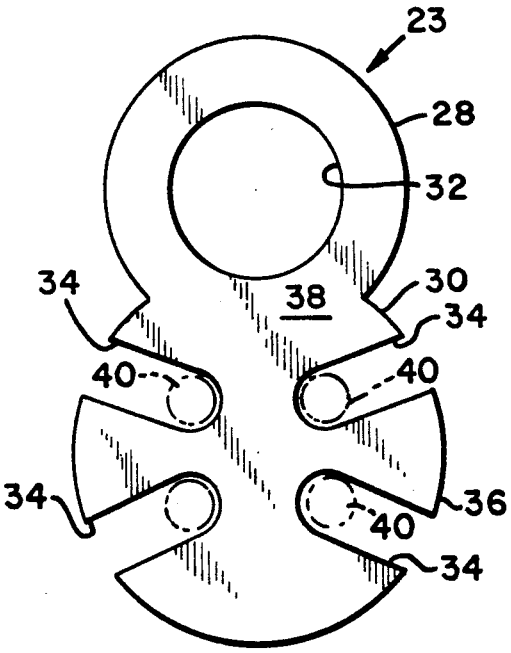
FIG. 3 is a front elevational view of a figure-8 continuous tap connector.

FIG. 3 illustrates a figure-8 continuous tap connector 23 having upper 28 and lower 30 body portions with the upper body portions having a ground rod opening 32 substantially similar to the embodiment of FIGS. 1 and 2. The lower body portion is provided with a plurality of channels 34 extending generally radially from the connector side wall perimeter 36 to the interior of the connector and being open at the front 38 and (not shown) rear faces for accommodating a plurality of ground conductors without the need for cutting the ground conductors. For example, a ground conductor 40 may be connected at opposite ends to different items requiring grounding such as equipment installed in a telecommunications building in which the continuous ground wire extends from one piece of equipment through the connector to the other piece of equipment occupying two channels in the connector without the need to cut the ground wire when applying it to each piece of equipment. This simplifies installation in that multiple pieces of equipment can be grounded quickly and through a single crimping step.

Figure 4:
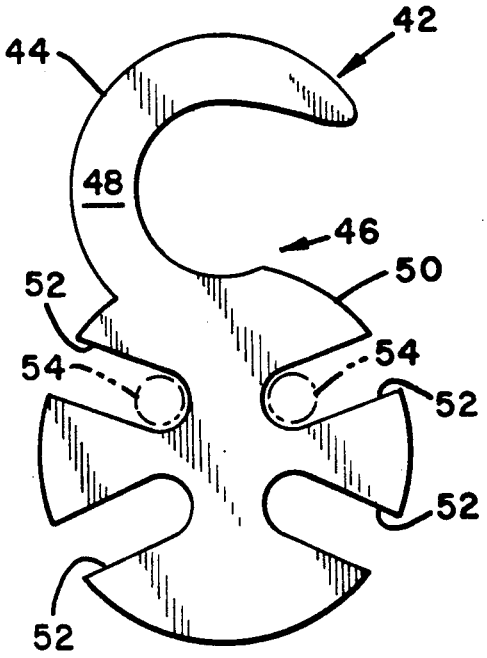
FIG. 4 is a front elevational view of a figure-8 continuous run and tap connector.
Figure 5:
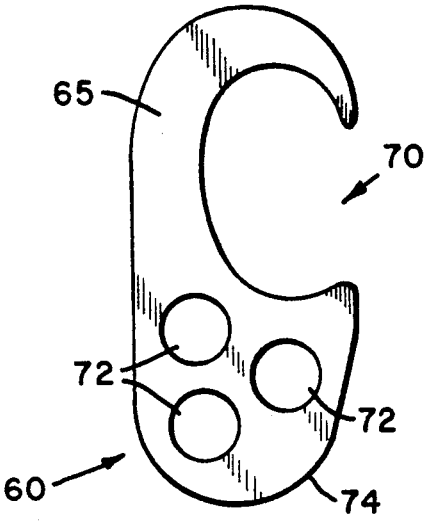
FIG. 5 is a front elevational view of a figure-6 connector in which there are a multiple of connections for cut conductors.

FIG. 4 discloses a figure-8-type continuous run and tap ground connector 42 in which the upper portion 44 of the connector body includes a channel 46 open at the front 48 and rear (not shown) faces of the connector and along the side wall 50 so that the conductor may be hooked on and crimped in place over a ground rod for ease of application thereto. The lower portion of the connector has a plurality of radially extending channels 52 for application to ground conductors 54 substantially in the same mode as the connector shown and described in FIG. 3.

Figure 6:
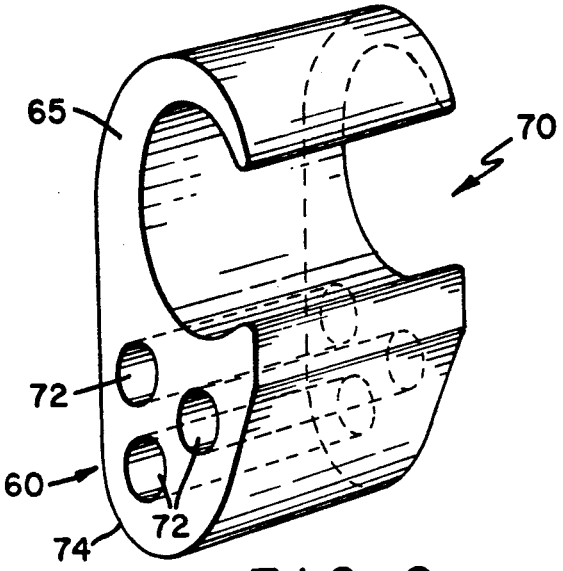
FIG. 6 is a perspective view thereof.

The invention also embraces several modifications in the form of figure-6 ground connectors 60–63 shown in FIGS. 5, 6 7, 8, and 9. In each of these configurations the upper portions 65 of the connector body is provided with a generally c-shaped cavity 70 occupying substantially the upper half portion of the connector and being used to receive and be crimped to a ground rod. The lower body portion of the connector receives the grounding conductors. For example, in the case of FIGS. 5 and 6 there are openings 72 located interiorly in the lower portion 74 of the connector extending through the front and rear faces for receiving cut ground conductors which are crimped in place.

Figure 7:
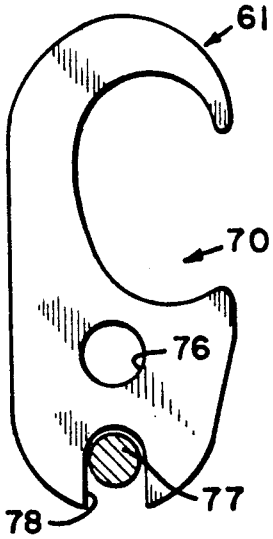
FIG. 7 is an elevational view of a figure-6-type connector which can accommodate spliced and continuous run conductors.
Figure 9:
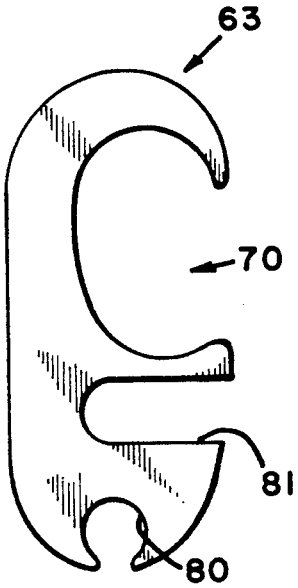

In FIG. 7 the connector 61 receives a spliced ground conductor in an interior opening 76 and a continuous run conductor 77 in the open channel 78 located at the bottom surface of the conductor. Similarly, in FIGS. 8 and 9 a figure-6-shaped connector accommodates continuous taps in the channels 79–81 occurring in the lower portion of the connector.

Having thus described our invention, we claim:

1. A metallic ground connector capable of being crimped comprising a unitary body with rear and front faces in the form of a figure-six having a C-shaped upper body portion defining an opening for receiving a ground rod and a generally solid lower body portion defined by a side wall and having a plurality of openings substantially equal in size and of a size smaller than the upper body portion opening extending interiorly of the lower body portion side wall between the rear and front faces for receiving a plurality of tap wires so that the connector can interconnect the ground rod and the plurality of tap wires in a single crimping action.

2. A metallic ground connector capable of being crimped comprising a unitary body with rear and front faces in the form of a figure-six having a C-shaped upper body portion defining an opening for receiving a ground rod and a generally solid lower body portion defined by a side wall and having a plurality of openings substantially equal in size and of a size smaller than the upper body portion opening for receiving tap wires including at least one opening extending interiorly of the lower body portion between the rear and front faces and within the side wall perimeter and at least one opening in the form of a channel extending through the front and rear faces and being open at the side wall so that the connector can interconnect a ground rod and a plurality of common size tap wires in a single crimping action.

3. A metallic ground connector capable of being crimped comprising a unitary body with rear and front faces in the form of a figure-six having a C-shaped upper body portion defining an opening for receiving a ground rod and a generally solid lower body portion defined by a side wall and having a plurality of openings substantially equal in size and of a size smaller than the upper body portion opening for receiving tap wires of common size, said openings being in the form of channels extending through the front and rear faces and being open at the side wall periphery so that the connector can interconnect a ground rod and a plurality of tap wires in a single crimping action.

4. A metallic ground connector capable of being crimped comprising an integral body member having rear and front faces and having a generally cylindrical first body portion defined by an upper side wall and a generally cylindrical second body portion defined by a lower side wall with the first body portion and second body portion joined in a figure-eight configuration, the first body portion having an opening therein extending from the front face through the rear face and interiorly of the side wall thereof for receiving a ground rod, and a plurality of openings substantially equal in size and of a size smaller than the upper body portion opening formed in the second body portion and extending from the front to rear faces interiorly of the side wall periphery thereof for receiving a plurality of ground wires of common size so that the connector when crimped secures the rod and wires.

5. A metallic ground connector capable of being crimped comprising an integral body member having rear and front faces and having a generally cylindrical first body portion defined by an upper side wall and a generally cylindrical second body portion defined by a lower side wall with the first body portion and second body portion joined in a figure-eight configuration, the first body portion having an opening therein extending from the front face through the rear face and interiorly of the side wall thereof for receiving a ground rod, and a plurality of openings substantially equal in size and of a size smaller than the upper body portion opening formed in the second body portion and extending from the front to the rear faces and being open at the side wall periphery thereof for receiving a plurality of ground wires of common size so that the connector when crimped secures the rod and wires.

6. A metallic ground connector capable of being crimped comprising an integral body member having rear and front faces and having a first body portion defined by an upper side wall and a second body portion defined by a lower side wall with the first body portion and second body portion joined in a figure-eight configuration, the first body portion having an opening therein extending from the front face through the rear face and along the side wall thereof for receiving a ground rod, and a plurality of openings substantially equal in size and of a size smaller than the upper body portion opening formed in the second body portion and extending from the front to the rear faces and being open at the side wall periphery thereof for receiving a plurality of ground wires of common size so that the connector when crimped secures the wires and closes the open upper side wall thereby securing the rod.

* * * * *